US009439264B2

(12) United States Patent
Hayashi et al.

(10) Patent No.: US 9,439,264 B2
(45) Date of Patent: Sep. 6, 2016

(54) LIGHTING CIRCUIT FOR LIGHT EMITTING ELEMENT AND ILLUMINATION APPARATUS INCLUDING SAME

(71) Applicant: Panasonic Corporation, Osaka (JP)

(72) Inventors: Yohei Hayashi, Osaka (JP); Hirofumi Konishi, Osaka (JP); Masanori Mishima, Kyoto (JP); Masanao Okawa, Nara (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 736 days.

(21) Appl. No.: 13/677,975

(22) Filed: Nov. 15, 2012

(65) Prior Publication Data

US 2013/0127366 A1 May 23, 2013

(30) Foreign Application Priority Data

Nov. 17, 2011 (JP) ..... 2011-251968

(51) Int. Cl.
*H05B 41/14* (2006.01)
*H05B 37/02* (2006.01)
*H05B 33/08* (2006.01)

(52) U.S. Cl.
CPC ..... *H05B 37/02* (2013.01); *H05B 33/08* (2013.01); *H05B 33/0818* (2013.01)

(58) Field of Classification Search
CPC ..... H05B 41/3927; H05B 33/0809; H05B 33/0842; H05B 41/2824; H05B 41/2828
See application file for complete search history.

(56) References Cited

U.S. PATENT DOCUMENTS

| | | | | |
|---|---|---|---|---|
| 8,330,381 | B2 * | 12/2012 | Langovsky | 315/209 R |
| 2002/0047601 | A1 * | 4/2002 | Shannon et al. | 315/224 |
| 2010/0109550 | A1 * | 5/2010 | Huda et al. | 315/287 |

FOREIGN PATENT DOCUMENTS

| | | |
|---|---|---|
| JP | H5-335085 | 12/1993 |
| JP | H07-192869 | 7/1995 |
| JP | 3378599 | 2/2003 |
| JP | 2003-280580 | 10/2003 |
| JP | 2005-78828 | 3/2005 |
| JP | 2007-227523 | 9/2007 |
| JP | 2009/54425 | 3/2009 |
| WO | 2009/055821 | 4/2009 |

OTHER PUBLICATIONS

Extended European Search Report for corresponding European Application No. 12192892.3 dated Feb. 21, 2013.

(Continued)

*Primary Examiner* — Douglas W Owens
*Assistant Examiner* — Monica C King
(74) *Attorney, Agent, or Firm* — Renner, Otto, Boisselle & Sklar, LLP

(57) ABSTRACT

A light-emitting-element lighting circuit for dimming a light emitting element by a PWM dimming signal of a duty ratio corresponding to an input dimming signal is provided. The lighting circuit includes a PWM dimming signal generating unit which generates the PWM dimming signal by performing a summation of AC wave signals including a fundamental wave and harmonics of different frequencies that are integer multiples of a fundamental frequency of the fundamental wave. The fundamental frequency is equal to or higher than a frequency, at which a sound pressure level is at maximum, in an audible frequency range in a correlation spectrum between the sound pressure level generated from the light emitting element and a frequency of an AC wave signal inputted to the light emitting element.

5 Claims, 6 Drawing Sheets

(56) References Cited

OTHER PUBLICATIONS

Japanese Office Action dated Apr. 21, 2015 issued in corresponding Japanese application No. 2011-251968 and English Summary thereof.

European Office Action dated Jun. 8, 2015 issued in corresponding European application No. 12192892.3.

Chinese Office Action, including search report, dated Jul. 29, 2015 issued in corresponding Chinese Patent Application No. 201210468381.7 and English translation thereof.

European Office Action dated Apr. 29, 2016 issued in corresponding European Patent Application No. 12192892.3.

* cited by examiner

LIGHTING CIRCUIT FOR LIGHT EMITTING ELEMENT AND ILLUMINATION APPARATUS INCLUDING SAME

FIELD OF THE INVENTION

The present invention relates to a lighting circuit for a light emitting element such as an organic electroluminescence (EL) element or the like, and an illumination apparatus including the lighting circuit.

BACKGROUND OF THE INVENTION

Conventionally, there has been known a lighting circuit for a light emitting element such as an organic EL element or the like, which is configured to generate a PWM dimming signal having a duty ratio corresponding to a light emission level specified by a dimming signal, and perform the dimming control.

For example, Japanese Patent Application Publication No. 2009-54425 describes a lighting circuit configured to perform a so-called burst dimming to stop the light emission of the light emitting element during the OFF period of the PWM dimming signal.

For example, in case of using an organic EL element as the light emitting element, it is problematic that audible sound (noise) is generated from the light emitting element when the frequency of a signal for performing the burst dimming is about 1 kHz. The organic EL element has a larger light emitting area compared to, e.g., a light emitting diode (LED), and thus the audible sound tends to increase.

Generally, the audible frequency range is from 20 Hz to 20 kHz. Thus, it is conceivable to operate the light emitting element by using a signal of a frequency exceeding the audible frequency range, e.g., a frequency of 20 kHz or more. However, it is difficult and expensive to stably operate the circuit which generates such inaudible high frequency signal.

SUMMARY OF THE INVENTION

In view of the above, the present invention provides a lighting circuit for a light emitting element which performs a burst dimming and suppresses a generation of audible sound from the light emitting element.

In accordance with an aspect of the present invention, there is provided a light-emitting-element lighting circuit for dimming a light emitting element by a PWM dimming signal of a duty ratio corresponding to an input dimming signal, the lighting circuit including: a PWM dimming signal generating unit which generates the PWM dimming signal by performing a summation of AC wave signals including a fundamental wave and harmonics of different frequencies that are integer multiples of a fundamental frequency of the fundamental wave.

Further, the fundamental frequency may be equal to or higher than a frequency, at which a sound pressure level is at maximum in an audible frequency range, in a correlation spectrum between the sound pressure level generated from the light emitting element and a frequency of an AC wave signal inputted to the light emitting element.

Further, the fundamental frequency may be lower than a frequency, at which a sound pressure level is at maximum in an audible frequency range, in a correlation spectrum between the sound pressure level generated from the light emitting element and a frequency of an AC wave signal inputted to the light emitting element.

Further, the fundamental frequency and a frequency of at least one of the harmonics are included in the audible frequency range.

Further, the PWM dimming signal may be represented by the following equation:

$$I = I_0 \cdot \frac{T_{on}}{T} + I_0 \sum \frac{2}{n\Pi} \sin\left(n\Pi \frac{T_{on}}{T}\right) \cos(2n\pi f t),$$

where $I_0$ is a maximum amplitude value of a current, n is an integer equal to or greater than 1, and Ton/T is an ON duty ratio of a square wave.

Further, the light emitting element may be an organic electroluminescence (EL) light emitting element.

Further, the fundamental frequency may be provided in a plural number, and one of the plurality of the fundamental frequencies is selected for each duty ratio corresponding to the input dimming signal.

In accordance with another aspect of the present invention, there is an illumination apparatus including: one or more illumination panels, each having a light emitting element; and the lighting circuit described above for lighting the light emitting element.

In accordance with the light-emitting-element lighting circuit or the illumination apparatus of the present invention, the fundamental frequency to be used is equal to or higher than the frequency at the maximum sound pressure level in the audible frequency range, and the sound pressure levels at the frequencies of the harmonics do not exceed the maximum sound pressure level. Therefore, the total sound pressure level becomes low when generated by using the PWM dimming signal of the square wave obtained by the summation of AC wave signals including the fundamental wave and harmonics of different frequencies that are integer multiples of the fundamental frequency of the fundamental wave. As a result, in the light-emitting-element lighting circuit which performs the burst dimming and the illumination apparatus, it is possible to suppress the generation of the audible sound from the light emitting element without using a high fundamental frequency exceeding the audible frequency range.

BRIEF DESCRIPTION OF THE DRAWINGS

The objects and features of the present invention will become apparent from the following description of embodiments, given in conjunction with the accompanying drawings, in which:

FIGS. 1A and 1B show an illumination apparatus having a lighting circuit for a light emitting element in accordance with a first embodiment of the present invention, wherein FIG. 1A is a perspective view of the illumination apparatus, and FIG. 1B is a cross-sectional view of the illumination apparatus;

DETAILED DESCRIPTION OF THE EMBODIMENTS

The present invention will now be described with reference to embodiments shown in the accompanying drawings which form a part hereof.

A lighting circuit for a light emitting element of an illumination apparatus in accordance with embodiments of the present invention is a circuit which performs a burst dimming of a light emitting element such as an organic electroluminescence (EL) element based on a PWM dimming signal of a duty ratio corresponding to a dimming signal inputted from a controller which sets a dimming level. The lighting circuit for a light emitting element includes a PWM dimming signal generating unit for generating the PWM dimming signal by performing a summation (operation represented by "Σ") of AC wave signals including a fundamental wave and harmonics of different frequencies that are integer multiples of the fundamental frequency of the fundamental wave. The PWM dimming signal generating unit uses the fundamental frequency at which a sound pressure level generated from the light emitting element is low. The fundamental frequency is a frequency within the audible frequency range determined in advance based on a correlation spectrum between the sound pressure level generated from the light emitting element and a frequency of an AC wave signal inputted to the light emitting element.

First Embodiment

Figure 1A:
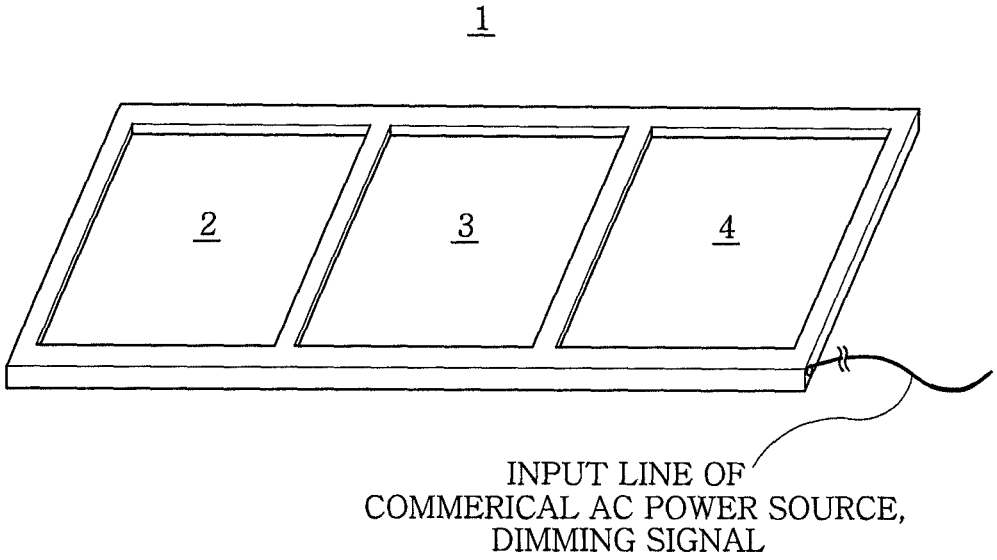
Figure 1B:
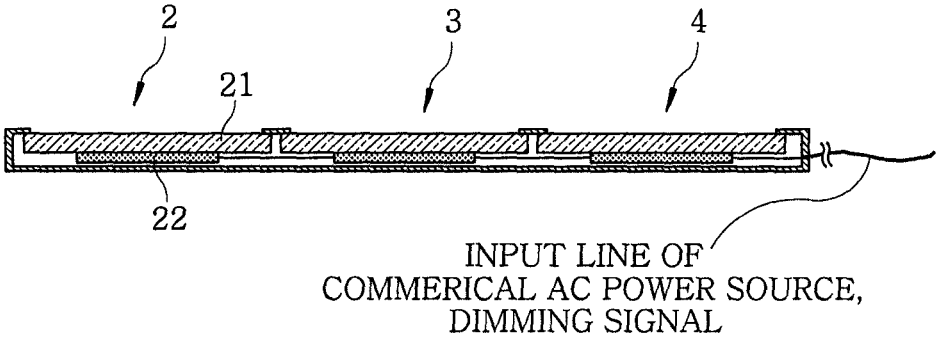

FIGS. 1A and 1B show an illumination apparatus 1 in accordance with a first embodiment of the present invention. FIG. 1A is a perspective view of the illumination apparatus 1 fixed to a ceiling, wall, floor, stand or the like. The illumination apparatus 1 includes three light emitting panels 2, 3 and 4, each having a light emitting surface oriented upward in FIG. 1A. FIG. 1B is a cross-sectional view of the illumination apparatus 1. The light emitting panels 2, 3 and 4 have the same configuration.

In the following, a description will be made using the light emitting panel 2 as an example. The light emitting panel 2 includes an organic EL light emitting element 21 and a light-emitting-element lighting circuit (hereinafter, simply referred to as lighting circuit) 22 which performs a burst dimming of the light emitting element 21. The lighting circuit 22 is connected to a commercial AC power source having a frequency of 50 Hz or 60 Hz, and a cable to which the dimming signal is inputted. The dimming signal is a signal which specifies light emission levels of a plurality of gradations and is outputted in response to the operation of, e.g., a sliding or rotary controller (not shown).

The lighting circuit 22 generates a PWM modulation signal of a duty ratio corresponding to the light emission level specified by the dimming signal, and performs the burst dimming of the light emitting element based on the ON period and OFF period of the PWM modulation signal.

Figure 2:
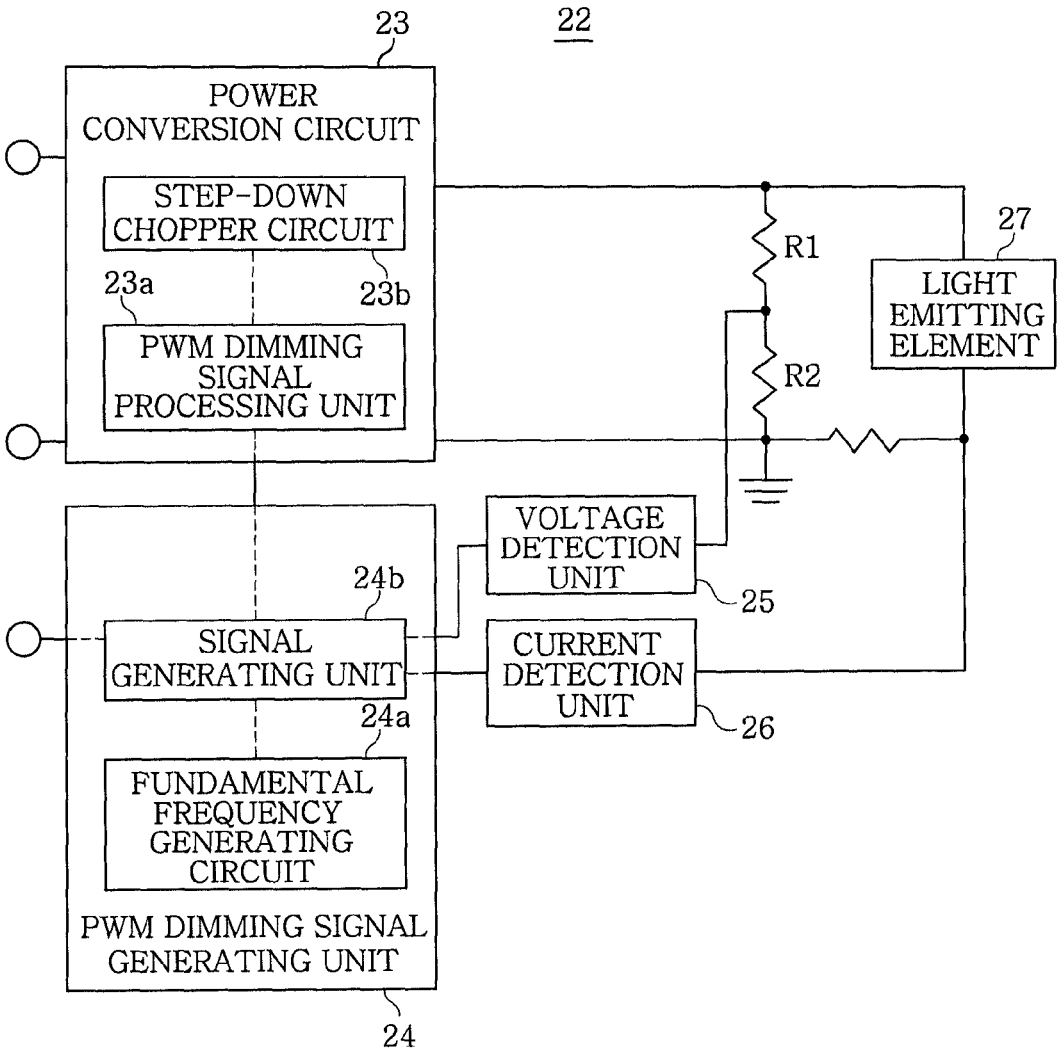
FIG. 2 is a circuit diagram of the lighting circuit for the light emitting element in accordance with the first embodiment of the present invention.

FIG. 2 is a circuit diagram of the lighting circuit 22. The lighting circuit 22 includes a power conversion circuit 23, a PWM dimming signal generating unit 24, a voltage detection unit 25, a current detection unit 26, and an organic EL light emitting element 27.

The power conversion circuit 23 converts an input voltage from the commercial AC power source into a DC application voltage for the burst dimming of the light emitting element 27 to output the DC application voltage to the light emitting element 27. The application voltage is a square pulse signal having ON and OFF periods in which the light emitting element 27 is turned on and off at a specific duty ratio. The power conversion circuit 23 includes a PWM dimming signal processing unit 23*a*, and a step-down chopper circuit 23*b*. During the ON period of the PWM dimming signal inputted from the PWM dimming signal generating unit 24, the PWM dimming signal processing unit 23*a* generates a drive signal (a chopper signal) for driving the step-down chopper circuit 23*b* and outputs the drive signal to a drive transistor (not shown) of the step-down chopper circuit 23*b*.

The PWM dimming signal generating unit 24 includes a fundamental frequency generating circuit 24*a* and a signal generating unit 24*b*. The fundamental frequency generating circuit 24*a* generates a signal of the fundamental wave of the fundamental frequency, which will be described later, and outputs the signal to the signal generating unit 24*b*. The signal generating unit 24*b* generates the PWM dimming signal of a duty ratio corresponding to the dimming signal, and outputs the PWM dimming signal to the power conversion circuit 23. First, the signal generating unit 24*b* performs a summation of AC wave signals including a fundamental wave and harmonics, the harmonics having different frequencies that are integer multiples (2, 3, . . . ) of the fundamental frequency of the fundamental wave and amplitudes obtained by dividing an amplitude of the fundamental wave by the values of the corresponding integer multiples. The signal generating unit 24*b* outputs the signal, obtained by the summation whose potential at a low level is set to 0 V, as the PWM dimming signal. The voltage detection unit 25 detects the voltage applied to the light emitting element 27 through a voltage divider circuit including resistors R1 and R2 connected in series. The current detection unit 26 detects a current flowing through the light emitting element 27. The PWM dimming signal generating unit 24 performs a feedback control process such that the voltage applied to the light emitting element 27 becomes a desired value based on the detection values obtained by the voltage detection unit 25 and the current detection unit 26.

Figure 3:
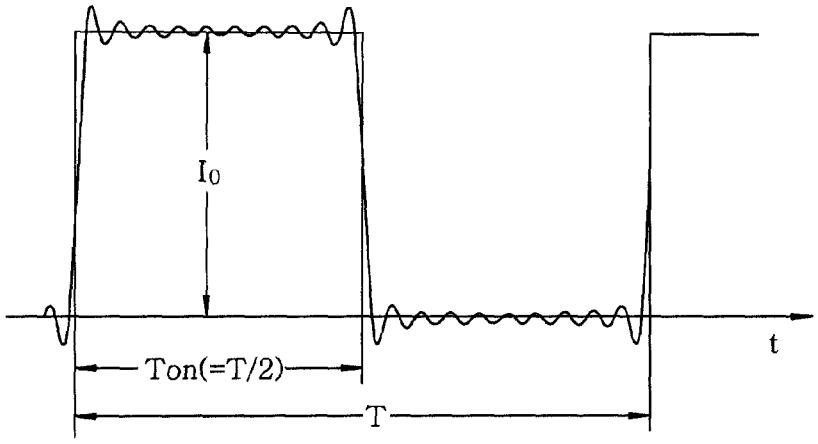
FIG. 3 shows an example of a PWM dimming signal.

FIG. 3 shows an example of the PWM dimming signal of a square wave having a duty ratio of 50%. For example, the PWM dimming signal is given by the following equation:

$$I = I_0 \cdot \frac{T_{on}}{T} + I_0 \sum \frac{2}{n\pi} \sin\left(n\pi \frac{T_{on}}{T}\right) \cos(2n\pi f t), \qquad \text{Eq. 1}$$

where $I_0$ is a maximum amplitude value of the current, n is an integer equal to or greater than 1, and Ton/T is an ON duty ratio of the square wave.

The first term in Eq. 1 is a term for setting the potential of the PWM dimming signal at a low level to 0 V.

Figure 4:
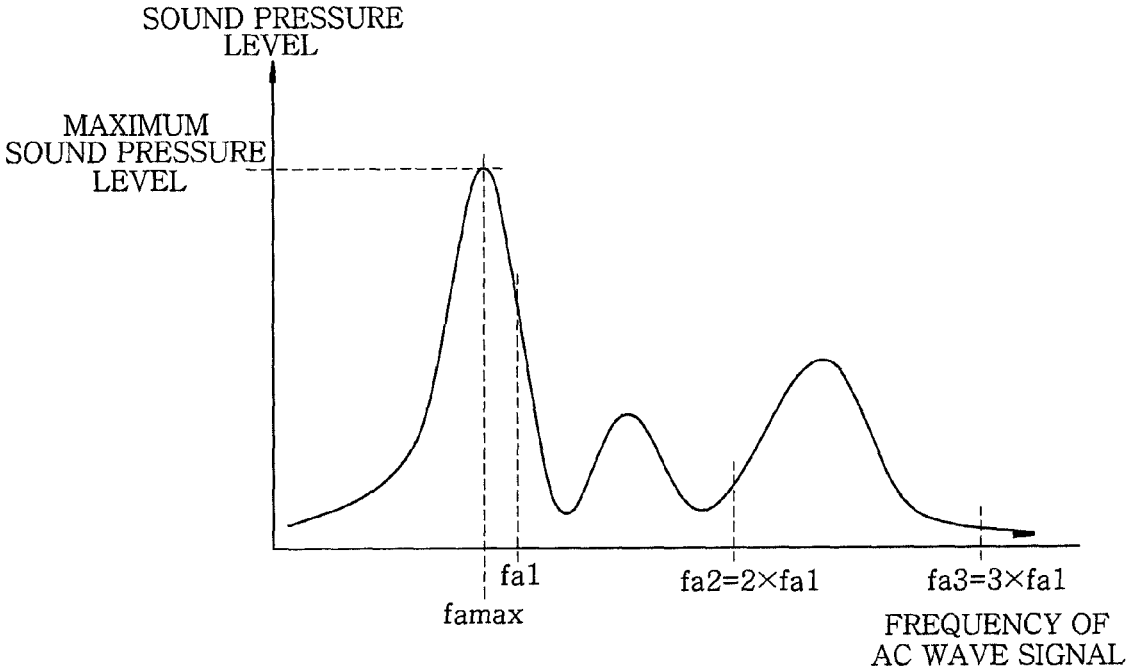
FIG. 4 is a graph showing a correlation spectrum between a sound pressure level of audible sound generated from the light emitting element and a frequency of an AC wave signal inputted to the light emitting element.

FIG. 4 is a graph showing a correlation spectrum (sound pressure characteristics) between a sound pressure level of audible sound generated from the light emitting element 27 and a frequency of an AC wave signal having no accompanying harmonics inputted to the light emitting element 27. The human audible frequency range is generally from 20 Hz to 20 kHz. The light emitting element 27 has specific oscillation characteristics due to its structure. Therefore, it is preferable that the correlation spectrum is investigated for the light emitting element 27 that is actually installed in the lighting circuit 22. However, there may be used the statistical data obtained by investigating multiple light emitting elements having the same configuration as the light emitting element 27. The sound pressure level is measured by using, for example, a sound level meter equipped with a frequency weighting filter that tends to represent the frequency characteristic of A-weighting curve or its equivalent or more among ordinary sound level meters specified by JISC1502.

From the graph shown in FIG. 4, the sound pressure level is maximum at a frequency famax. For example, the frequency famax of the organic EL light emitting element used in the experiment was 1.5 kHz. Hereinafter, the sound pressure level at a frequency famax is referred to as a maximum sound pressure level. The PWM dimming signal generating unit 24 uses a frequency fa1 equal to or higher than the frequency famax as the fundamental frequency. Further, generally, as the fundamental frequency is lowered, it is easier to control and the circuit cost is also lowered. Thus, the frequency fa1 is equal to or slightly greater than the frequency famax, and is set such that the frequency of a harmonic that is an integer multiple of the fundamental frequency, e.g., the third harmonic, preferably, the fifth harmonic, more preferably, the seventh or higher harmonic is equal to or less than 20 kHz.

Next, description will be made in case where the PWM dimming signal is generated by using harmonics (the second harmonic and the third harmonic) of a frequency fa2 that is twice the fundamental frequency and a frequency fa3 that is three times the fundamental frequency in addition to the fundamental frequency fa1 (fundamental wave). The sound pressure level generated from the light emitting element 27 by the second harmonic and the third harmonic is lower than the maximum sound pressure level even in case of having the same amplitude. Further, in Eq. 1, maximum amplitudes of the second harmonic and the third harmonic are set to be ½ and ⅓ of the signal of the fundamental frequency, respectively. As a result, the sound pressure level of the audible sound generated from the light emitting element 27 can be suppressed to a low level.

As described above, in the lighting circuit 22 which performs the burst dimming and the illumination apparatus 1 having the lighting circuit 22 in accordance with the first embodiment of the present invention, the fundamental frequency to be used is equal to or higher than the frequency at the maximum sound pressure level in the audible frequency range. For this reason, the sound pressure levels even at the frequencies of the harmonics do not exceed the maximum sound pressure level. Therefore, the total sound pressure level becomes low when generated by using the PWM dimming signal of the square wave obtained by the summation of AC wave signals including the fundamental wave and harmonics of different frequencies that are integer multiples of the fundamental frequency of the fundamental wave. As a result, in the lighting circuit 22 which performs the burst dimming and the illumination apparatus 1 having same, it is possible to suppress the generation of the audible sound from the light emitting element without using a high fundamental frequency exceeding the audible frequency range.

Second Embodiment

The lighting circuit in accordance with a second embodiment of the present invention is configured to switchably use a plurality of fundamental frequencies, and generate the PWM dimming signal by selecting the fundamental frequency, at which the sound pressure level of the audible sound is the lowest, for each duty ratio corresponding to the input dimming signal.

Figure 5:
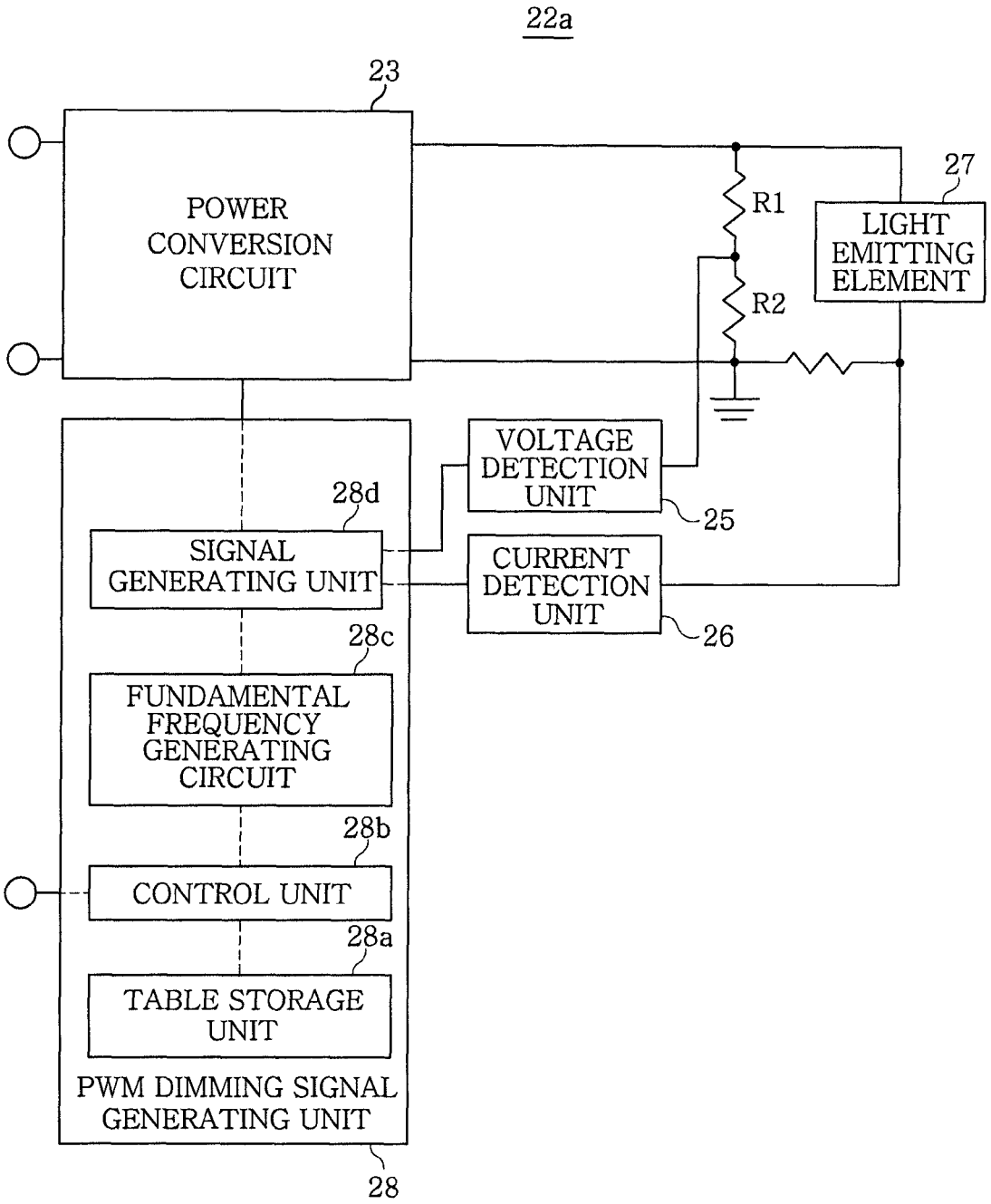
FIG. 5 is a circuit diagram of a lighting circuit for a light emitting element in accordance with a second embodiment of the present invention.

FIG. 5 is a circuit diagram of a light-emitting-element lighting circuit 22*a* in accordance with a second embodiment of the present invention. The same reference numerals will be given to the same components as those of the light emitting element lighting circuit 22 in accordance with the first embodiment of the present invention, and a redundant description will be omitted. The lighting circuit 22*a* includes the power conversion circuit 23, a PWM dimming signal generating unit 28, the voltage detection unit 25, the current detection unit 26, and the light emitting element 27.

The PWM dimming signal generating unit 28 includes a table storage unit 28*a*, a control unit 28*b*, a fundamental frequency generating circuit 28*c*, and a signal generating unit 28*d*. The control unit 28*b* specifies the fundamental frequency corresponding to the duty ratio determined by the input dimming signal from a look-up table stored in the table storage unit 28*a*. The fundamental frequency generating circuit 28*c* generates a signal of the fundamental frequency specified by the control unit 28*b*, and outputs the signal to the signal generating unit 28*d*. The signal generating unit 28*d* performs a summation of AC wave signals including a fundamental wave and harmonics having frequencies that are integer multiples (2, 3, . . . ) of the fundamental frequency of the fundamental wave and amplitudes obtained by dividing the amplitude of the fundamental wave by the values of the corresponding integer multiples. By performing such summation, the signal generating unit 28*d* generates and outputs the PWM dimming signal of a duty ratio determined by the control unit 28*b* to the power conversion circuit 23 after setting a potential of the PWM dimming signal at a low level to 0 V. (see Eq. 1).

Figure 6:
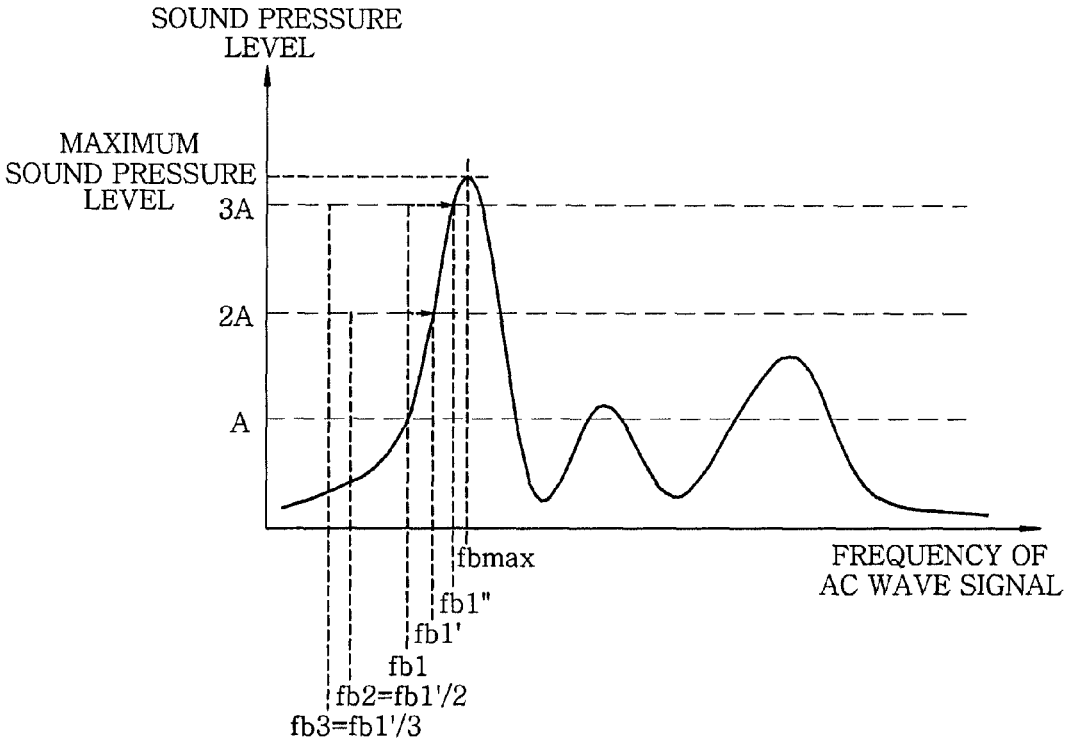
FIG. 6 is a graph showing a correlation spectrum between a sound pressure level of audible sound generated from the light emitting element and a frequency of an AC wave signal inputted to the light emitting element.

The look-up table is a table specifying the fundamental frequency corresponding to each duty ratio on a one-to-one basis, and is created by the following steps 1 to 3. FIG. 6 is a graph showing a correlation spectrum (sound pressure characteristics) between a sound pressure level of the audible sound generated from the light emitting element and a frequency of an AC wave signal having no accompanying harmonics inputted to the light emitting element 27. FIG. 6 explains a method to specify the first to third fundamental frequencies. Hereinafter, the steps for creating the look-up table will be described with reference to FIG. 6.

First, in step 1, in the graph shown in FIG. 6, a first frequency fb1 is referred to as a frequency lower than a frequency fbmax at which the sound pressure level of the audible sound is at maximum.

Secondly, in step 2, a frequency value of 1/m times a frequency, at which a sound pressure level of m times (m is an integer of 2 or more) a sound pressure level A at the first frequency fb1 is generated, is defined as an m-th frequency. If a value of m is 2 or 3, a frequency, at which a sound pressure level 2A that is twice the sound pressure level A is generated, is represented by fb1' or a frequency, at which a sound pressure level 3A that is three times the sound pressure level A is generated, is represented by fb1". The second frequency fb2 is set to fb1"/2, and the third frequency fb3 is set to fb1"/3 (see FIG. 6). A case where the value of m is 2 and 3 will be described below.

In step 3, in the case of using each of the first to third frequencies fb1, fb2 and fb3 as the fundamental frequency, the frequency, at which the sound pressure level is the lowest in each duty ratio within a range of use, is determined as the fundamental frequency corresponding to each duty ratio on a one-to-one basis. In this process, it is assumed that the maximum sound pressure level is the same in case of using each of the first to m-th frequencies as the fundamental frequency, and, in the correlation spectrum, a value obtained by dividing a sound pressure level at a frequency of harmonic that is (m+n) times the m-th frequency by (m+n) (n is a natural number) is less than the sound pressure level at the first frequency.

Figure 7A:
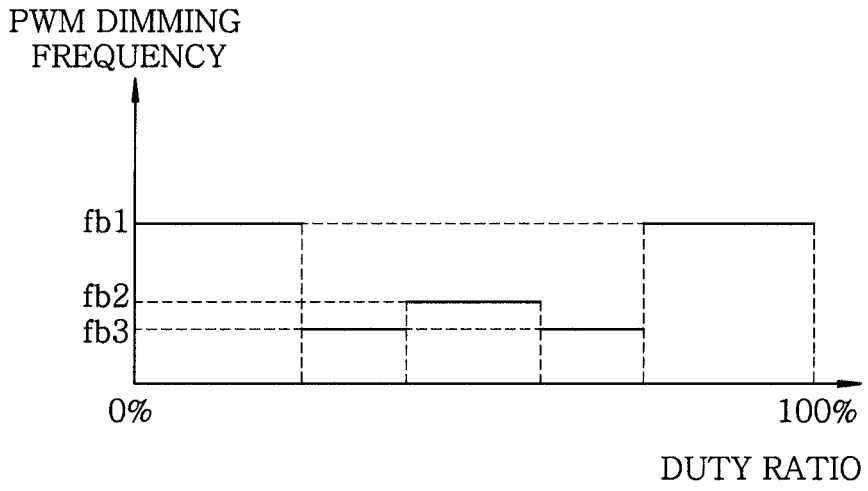
FIG. 7A illustrates frequencies selected for individual duty ratios.
Figure 7B:
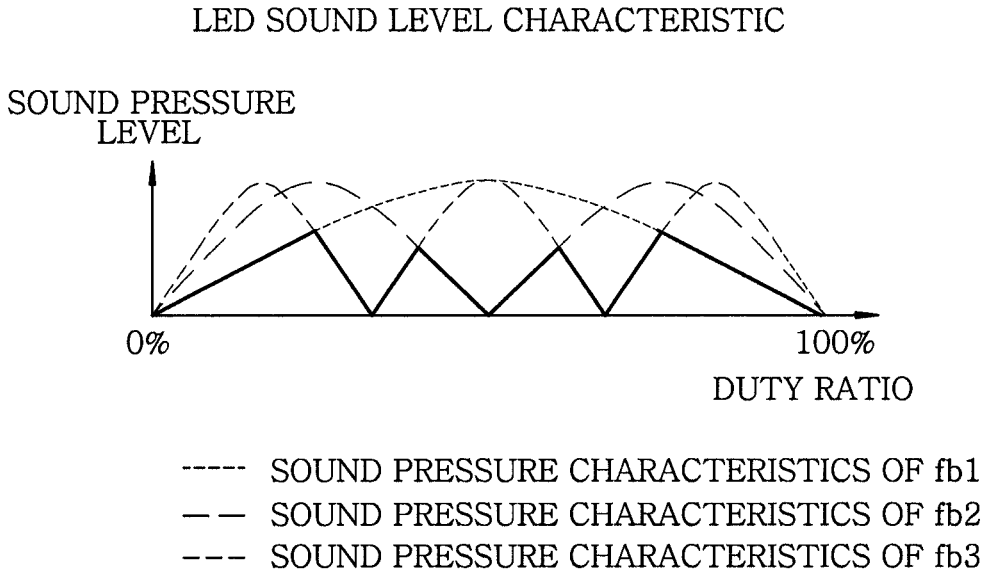
FIG. 7B shows a relationship between the sound pressure level and the fundamental wave, the second harmonic, and the third harmonic.

FIGS. 7A and 7B are graphs for explaining a process performed in the step 3. FIG. 7A illustrates a one-to-one correspondence relationship between the fundamental frequency and the duty ratio of the PWM dimming signal. The correspondence relationship shown in FIG. 7A is stored as a look-up table in the table storage unit 28*a*. In the graph shown in FIG. 7B, when considering the fundamental wave (i.e., the fundamental wave of the first frequency fb1), the second harmonic (i.e., the wave of the frequency fb1' which is the second harmonic of the second frequency fb2), and the third harmonic (i.e., the wave of the frequency fb1" which is the third harmonic of the frequency fb3) all of which have the same maximum sound pressure level A with respect to the duty ratio of the PWM dimming signal, the sound pressure levels of the fundamental wave, the second harmonic, and the third harmonic generated from the light emitting element 27 are represented by different dotted lines, and the lowest one of the sound pressure levels for each duty ratio is represented by a solid line.

By using the method of specifying the fundamental frequency, the frequencies fb1, fb2 and fb3, at which the characteristics of the fundamental wave, the second harmonic, and the third harmonic appear predominantly, can be respectively selected in the relationship between the duty ratio and the sound pressure level. FIG. 7A shows that in the case where the frequency indicated by the solid line in FIG. 7B is the fundamental wave, the first frequency fb1 is selected as the fundamental frequency; in the case where the frequency indicated by the solid line in FIG. 7B is the second harmonic, the second frequency fb2 is selected as the fundamental frequency; and in the case where the frequency indicated by a solid line in FIG. 7B is the third harmonic, the frequency fb3 is selected as the fundamental frequency.

With such configuration, the lighting circuit 22*a* generates the PWM dimming signal in response to the dimming signal by using the AC wave signal having the frequency, at which the sound pressure level generated from the light emitting element 27 is the lowest, as the fundamental frequency. Thus, it is possible to reduce the sound pressure level of the audible sound generated from the light emitting element 27 during the operation although the frequency lower than the frequency fbmax is set to the first frequency fb1.

Further, with regard to the lighting circuit 22*a*, the matters required to achieve the advantageous effects are as follows.

The lighting circuit 22*a* is a circuit for dimming the light emitting element by the PWM dimming signal of the duty ratio corresponding to the dimming signal inputted from the controller which sets the dimming level, and includes the PWM dimming signal generating unit 28 which generates the PWM dimming signal by performing the summation of AC wave signals including a fundamental wave and harmonics of different frequencies that are integer multiples of the fundamental frequency of the fundamental wave. The PWM dimming signal generating unit 28 includes the table storage unit 28*a*, the control unit 28*b*, the fundamental frequency generating circuit 28*c* and the signal generating unit 28*d*.

The look-up table stored in the table storage unit 28*a* is a table which (a) specifies a frequency at the maximum sound pressure level in the audible frequency range in the correlation spectrum between the sound pressure level generated from the light emitting element and the frequency of the AC wave signal inputted to the light emitting element, (b) sets a frequency lower than the specified frequency as the first frequency and defines a frequency value of 1/m times a frequency, at which a sound pressure level of m times (m is an integer of 2 or more) a sound pressure level at the first frequency is generated, as the m-th frequency, and (c), in the case of using each of the first to m-th frequencies as the fundamental frequency, defines the relationship between the duty ratio and the fundamental frequency specified for each duty ratio at which the sound pressure level is the lowest.

The control unit 28*b* (d) determines the fundamental frequency corresponding to the duty ratio determined by the dimming signal based on the look-up table, and (e) outputs a signal of the determined fundamental frequency from the fundamental frequency generating circuit to the signal generating unit. The signal generating unit 28*d* generates the PWM dimming signal by performing the summation of AC wave signals including a fundamental wave of the determined fundamental frequency and harmonics having frequencies that are integer multiples (2, 3, . . . ) of the determined fundamental frequency and outputs the PWM dimming signal.

Further, the correlation spectrum has a waveform similar to a Gaussian function as shown in FIG. 4. In particular, the lighting circuit operates effectively if, in the correlation spectrum, a value obtained by dividing a sound pressure level at a frequency of harmonic that is (m+n) times the m-th frequency by (m+n) is less than the sound pressure level at the first frequency.

The present invention is not limited to the configurations of the first and second embodiments and can be modified variously without departing from the spirit of the present invention. For example, in the first and second embodiments, it has been described a case where AC waves used to generate the PWM dimming signal in the PWM dimming signal generating units 24 and 28 include up to the third harmonic which is three times the fundamental frequency. However, advantageous effects can be also obtained by using AC waves including a higher harmonic than the third harmonic as long as conditions regarding the correlation spectrum are met. Further, in the second embodiment, the table storage unit 28*a*, the control unit 28*b* and the fundamental frequency generating circuit 28*c* may be realized by a hardware circuit having an equivalent function.

The light-emitting-element lighting circuit of the present invention can be used in various circuits which generate the audible sound in accordance with the burst dimming of the light emitting element.

While the invention has been shown and described with respect to the embodiments, it will be understood by those skilled in the art that various changes and modification may be made without departing from the scope of the invention as defined in the following claims.

What is claimed is:

1. A light-emitting-element lighting circuit for dimming a light emitting element by a PWM dimming signal, the lighting circuit comprising:

a PWM dimming signal generating unit adapted to generate the PWM dimming signal of a duty ratio corresponding to an input dimming signal by performing a summation of AC wave signals including a fundamental wave and harmonics that are different integer multiples of a fundamental frequency of the fundamental wave, wherein the fundamental frequency is in an audible frequency range and is lower or higher than a frequency in the audible frequency range, at which a sound pressure level generated from the light emitting element is at maximum, and wherein the PWM dimming signal is represented by the following equation:

$$I = I_0 \cdot \frac{T_{on}}{T} + I_0 \sum \frac{2}{n\pi} \sin\left(n\pi \frac{T_{on}}{T}\right) \cos(2n\pi f t),$$

where $I_0$ is a maximum amplitude value of a current, n is an integer equal to or greater than 1, and Ton/T is an ON duty ratio of a square wave.

2. The lighting circuit of claim 1, wherein a frequency of at least one of the harmonics is included in the audible frequency range.

3. The lighting circuit of claim 1, wherein the light emitting element is an organic electroluminescence (EL) light emitting element.

4. The lighting circuit of claim 1, wherein the lighting circuit is adapted to select one of a plurality of frequencies lower than the frequency in the audible frequency range as the fundamental frequency to be used in the generation of the PWM dimming signal the selected one causing the light emitting element to generate a lowest sound pressure level for the duty ratio corresponding to the input dimming signal.

5. An illumination apparatus comprising:

one or more illumination panels, each having a light emitting element; and the lighting circuit described in claim 1 for lighting the light emitting element.

* * * * *